United States Patent [19]

Volinskie

[11] 4,083,615

[45] Apr. 11, 1978

[54] CONNECTOR FOR TERMINATING A FLAT MULTI-WIRE CABLE

[75] Inventor: Robert Volinskie, Hershey, Pa.

[73] Assignee: AMP Incorporated, Harrisburg, Pa.

[21] Appl. No.: 763,210

[22] Filed: Jan. 27, 1977

[51] Int. Cl.[2] ..... H01R 11/32

[52] U.S. Cl. ..... 339/17 F; 339/99 R; 39/176 M; 339/176 MF

[58] Field of Search ..... 339/14 R, 17 F, 99 R, 339/176 M, 176 MF, 97 R, 97 P, 98

[56] References Cited

U.S. PATENT DOCUMENTS

| | | | |
|---|---|---|---|
| 3,731,254 | 5/1973 | Key | 339/17 F |
| 3,864,011 | 2/1975 | Huber | 339/176 MF |
| 3,963,319 | 6/1976 | Schumacher | 339/176 MF |
| 4,025,141 | 5/1977 | Thelissen | 339/99 R |

FOREIGN PATENT DOCUMENTS

| | | | |
|---|---|---|---|
| 2,500,189 | 7/1975 | Germany | 339/99 R |

*Primary Examiner*—Mark S. Bicks
*Attorney, Agent, or Firm*—D. W. Phillion

[57] ABSTRACT

A connector for terminating the wires of a flat cable directly into slots in plate-like terminal portions of contacts which are contained in said connector and without the use of solder. Two or more rows of the slotted terminals are arranged on a flat bed surface of the connector housing with the said slotted terminals extending vertically upwardly from said bed surface and further with the slotted terminals in a first row being interleaved with the slotted terminals in the second row. In addition to the slotted plate-like terminals, each contact comprises a second terminal means, such as a female receptacle, for receiving a terminal post from an external source. The contacts are designed in two different configurations which enables the receptacle portion of a contact of a first configuration to be positioned directly over the receptacle portion of a contact of the second configuration, while permitting the slotted plate-like terminals to be interleaved on the bed surface of the connector housing. The wires of the cable are simultaneously moved downward into desired slots in a single motion to perform the gang termination of such wires.

10 Claims, 13 Drawing Figures

CONNECTOR FOR TERMINATING A FLAT MULTI-WIRE CABLE

BACKGROUND OF THE INVENTION

The invention relates generally to a connector means for terminating the individual conductors of a flat cable and more particularly to a connector means for terminating the individual wires of a multi-wire cable directly into slotted terminals contained within the connector and with the other end being optionally a female receptable, a post or any other desired type of termination desired.

In the prior art, and particularly in the telephone industry terminations of flat wire cables currently are made by means of paddle boards which consist of a small piece of printed circuit board to which the individual wires of the cable are soldered. Printed circuit paths then extend the soldered connections of the individual wires of the cable into a connector which is physically attached to the small portion of the circuit board. The aforementioned connector contains desired terminals, such as female terminals for the reception of terminal posts, or alternatively, some other type of terminal such as a terminal post. Such paddle board arrangement, however, is expensive and time consuming in assembly as well as in parts since it requires the soldering of the ends of the individual conductors of the cable onto the paddle board and also the soldering of the terminals in the connector to the other ends of the circuit paths on the paddle board.

Another difficulty encountered in the use of paddle boards is that each solder joint usually is done individually by a human operator. Accordingly the solder joints vary considerably even when done by the same person. Some of the solder joints are better than others and some are likely to be subject to early failure.

BRIEF STATEMENT OF THE INVENTION

It is a primary object of the present invention to provide a connector means for terminating the individual wires of a flat multi-wire cable directly into slots in slotted terminals contained within said connector.

A second object of the invention is the termination of a selected group of the wires of a flat wire cable into a first set of selected slotted terminals, all of which can be connected to a common reference potential such as ground, and to connect another group of wires of the flat cable to a second set of slotted terminals which are individually connected to output terminals which can be either receptacles, terminal posts or some other desired terminating means.

A further purpose of the invention is the arrangement of slotted plate-like terminals positioned vertically on a common bed surface of the connector so that the wires of the cable can all be terminated simultaneously by a single downward thrust upon the slotted terminals.

It is a further aim of the invention that the slotted terminals not only rest upon a common plane or bed but also can lie in two or more parallel rows positioned across the common bed with the individual terminals of the two rows of terminals being alternately spaced or interleaved in such a manner that wires can pass between the terminals of one row and be inserted in a slot in the second row of vertically oriented slotted terminals without interference from said first row of slotted terminals.

A fourth purpose of the invention is to provide a connector means for terminating the individual wires of a flat multi-wire cable by means of one or more rows of vertically oriented slotted terminals resting on a bed in the housing in such a manner that individual wires of a cable can be inserted in the slots of the slotted plate terminals in a single downward thrust, and further providing at least two levels of other terminal means, such as receptacles, for example, each of which is integrally connected to one of the vertically oriented slotted plates to form a complete contact with the contacts whose receptacles are in the upper level being configured such that the vertically oriented slotted terminals connected thereto are alternately interleaved with the slotted plate contacts whose attached receptacles are in the lower level of terminal means, and having no electrical connection between the contacts whose receptacles are in the upper level and the contacts whose receptacles are in the lower level.

It is a further object of the invention to provide a hermaphroditic type connector arrangement with two halves which are snapped or secured together in a parallel manner in the sense that each of the two halves are identical and consist of two or more rows of slotted plate-like terminals with each terminal of one row thereof being connected to a receptacle at the other end thereof which can receive terminal posts, for example, and further with each of the two sections of the connector being substantially mirror images of each other with plastic locking means formed on the housings thereof so that the said two sections can be snapped together to form a single connector with two tiers or levels of female receptacles, and with the two rows of slotted terminals of each section facing each other, and with the resulting structure being capable of accepting a separate cable in each of the two sections.

Another purpose of the invention is an improved manner of terminating the wires of a multi-wire cable directly onto the terminals in a connector.

In accordance with one form of the invention there is provided a connector housing having a substantially flat bed with at least two sets of contacts mounted thereon. Each of the contacts of the two sets of contacts has at one end thereof a slotted plate-like terminal and at the other end thereof a suitable terminating means such as a female receptacle for receiving a terminal post or alternatively a terminal post or some other desired terminating means. The contacts of the two sets of contacts are designed in such a manner that the slotted plate-like terminals can all rest upon a common bed surface in the connector housing and extend upwardly therefrom with the open ends of the slots facing the tops thereof. The slotted plate terminals of one set of contacts are positioned in a first row on the housing bed surface and the slotted plate terminals of the second set of contacts are positioned in a second row substantially parallel to the first row on the housing bed surface, with the individual slotted plate-like terminals of the first set being interleaved with the individual slotted plate-like terminals of the second set. Thus, wires from the multi-wire flat cable can, in a single downward thrust be inserted into the slots in the first and second rows of the slotted plate-like terminals without interference from each other since the slotted plate terminals in the first and second rows are interleaved. The two sets of contacts further are designed with offset portions so that the other end, that is, the receptacle end of the contact of one set can be positioned directly above the receptacle portion of a contact of the other set, thus providing two tiers of receptacle type terminations, one above the other, and with the upper tier consisting of the receptacles of the first set of contacts and the lower tier consisting of the receptacles of the second set of contacts.

In the process of assembling the connectors the individual wires of the multi-wire cable are stripped and spread apart by appropriate tooling and, in a single thrust, moved downwards en masse into the slots in the two rows of slotted terminals, with each row of slotted terminals being electrically connected in a predetermined desired arrangement. For example, one row of slotted terminals can be connected to ground potential.

Due to the offsetting configuration of the two sets of contacts the two rows of slotted terminals can be seated upon a common bed surface in the connector housing, or alternately, if desired, they can be seated upon bed surfaces of different heights. In some instances, it is possible to supply a third row of slotted terminals which are all connected to a common conductive strip which can be at ground potential and which can, if desired, be at a different level than the common level on which the first two rows of slotted terminals are seated. In this manner additional space is provided for the positioning of wires from the multi-wire cable into the slots of the grounded slotted terminals laying in the plane lower than the plane of the two other rows of slotted terminals. The said other two rows of slotted terminals can receive wires carrying data as opposed to being connected to a reference potential, such as ground.

In accordance with another form of the invention a first row of slotted plate terminals is vertically oriented upon a common bed of the plastic housing, all of which are connected to a common potential such as ground. A second row of slotted plate terminals, parallel with said first row but spaced apart a distance therefrom, are also mounted upon the common bed. The second row of slotted plate terminals have, at the other end thereof, female receptacles or terminal posts, for example, to which an external connection can be made. It is to be noted that the said other ends of said second row of slotted terminals lie in a single tier. The connector housing is designed such that two of said connectors can be positioned face-to-face in that the rows of slotted terminals in each of the two sections are facing each other in substantially mirror-image relationship. Appropriate locking means are provided on the housings to retain the two halves secured together. In this manner, a resulting connector is formed comprised of four rows of slotted terminals with two of such facing rows being connected to ground, for example, and with the other two rows of slotted terminals designed to receive data carrying wires from the cable. Each half of the completed connector is capable of terminating one multi-wire cable so that the overall connector will terminate two such multi-wire cables. The other ends of the data carrying terminals are arranged in two tiers of terminating means such as female receptacles or terminating posts as discussed above and which can be connected to an external means in a desired manner. Appropriate spacers are provided between the two connector sections to provide insulation means between the two rows of slotted contacts on each of the two sections of the connector as well as to maintain the proper physical spacing between the two connector sections.

In accordance with a third form of the invention there is provided two sets of contacts with slotted plate portions resting on a common bed in the connector housing and with the remainder of said two sets of contacts being terminated in post receiving receptacles or some other desired configuration. The contacts of each of the two sets have offset portions with respect to one another so that the receptacle portions can be arranged in two levels as discussed above in connection with another embodiment of the invention. A third row of slotted contacts rest on a housing surface level, preferably lower than the first two rows of slotted plate-like terminals, for the purpose of permitting wires to be terminated in the slots in the third row of slotted contacts with said terminated wires being located physically lower than the wires terminated in the first two rows of slotted contacts, thereby avoiding the congestion of wires which would occur if all of the cable wires extended into the connector in a common plane.

In accordance with a feature of the invention some of the connector configurations require that the pattern of ground and signal connections of such wires is that two adjacent wires are to be connected to ground, the next wire is a signal carrying wire to be connected to a slotted terminal, the next two wires to be connected to a ground, and so on, with the cycle being repeated over for all the wires in the multi-wire cable. A particular type of slotted terminal is employed to receive two wires in a single terminal. More specifically, the slotted terminal for receiving two wires has two slots formed therein which extend in a divergent manner from a common opening at the top of said slotted terminal, with each of the divergent slots receiving a single wire. For a more detailed description of such a double slotted termination, reference is made to co-pending United States patent application Ser. No. 713,724 filed Aug. 12, 1976, by Robert Volinskie of Hersey, Pennsylvania and entitled "Dual Slot Contact" and assigned to the same assignee as the present application.

BRIEF DESCRIPTION OF THE DRAWINGS

The above-mentioned objects and other objects and features of the invention will be more fully understood from the following detailed description thereof when read in conjunction with the drawings in which.

DETAILED DESCRIPTION OF THE INVENTION

Figure 1:
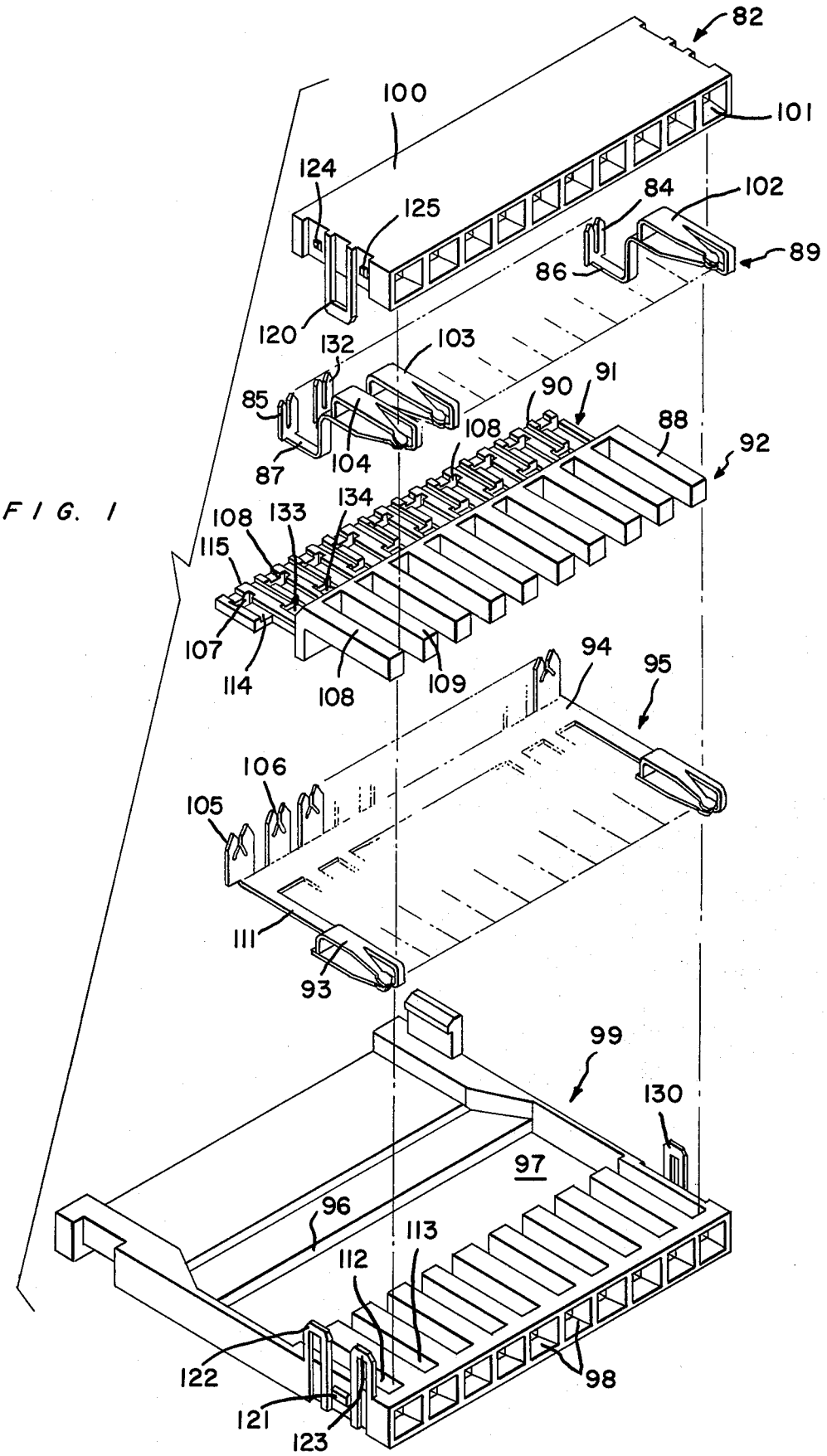
FIG. 1 is an exploded view of one form of the connector.
Figure 3:
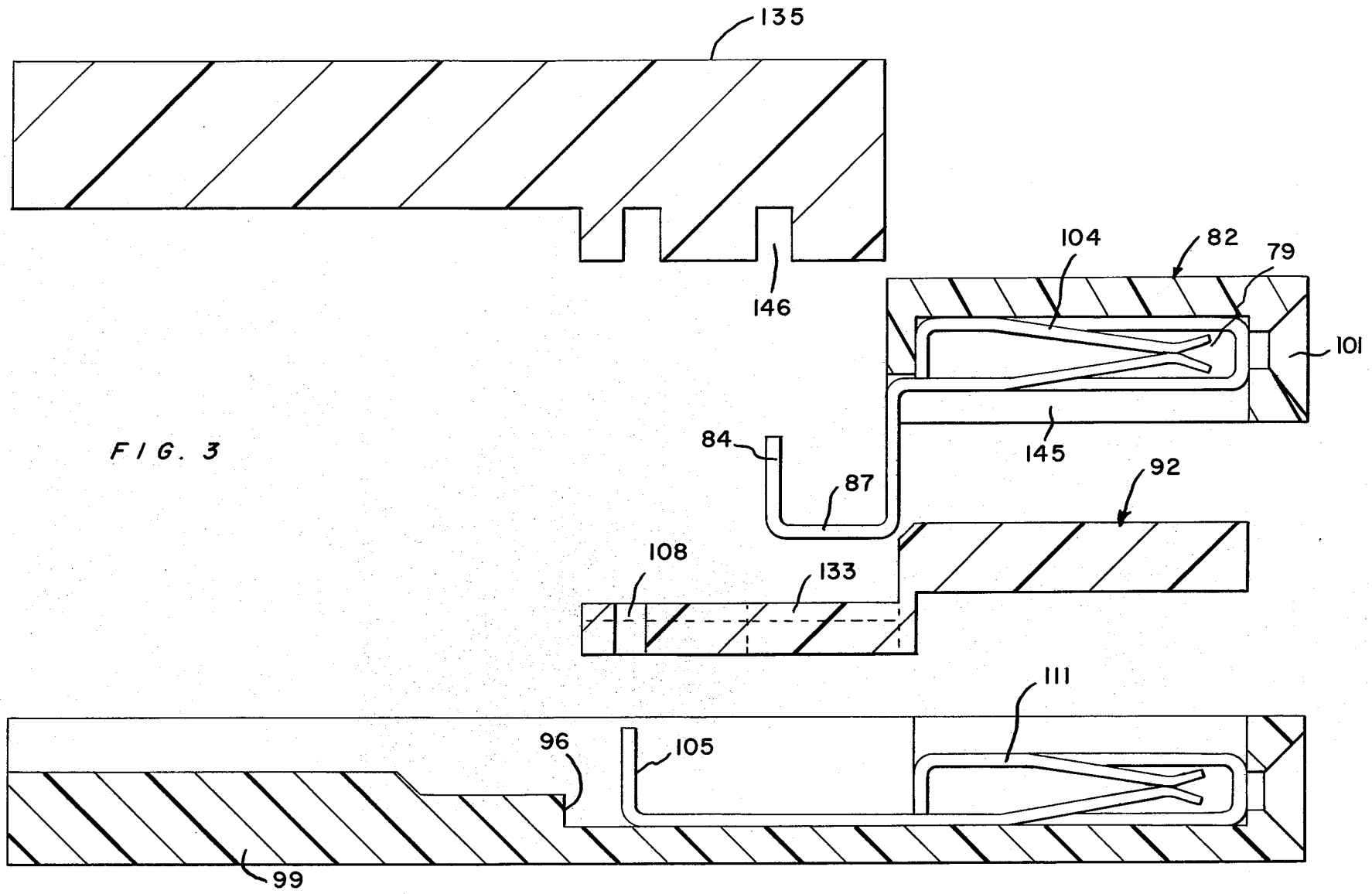
FIG. 3 is an exploded sectional view of the connector of FIG. 2 taken along the plane 3—3 but with some of the details omitted for purposes of clarity.

Referring now to FIG. 1 a plastic housing base 99 is shown with slots, such as slots 112 and 113 therein which lead into channels, such as channel 98, formed at one end thereof. The housing 99 has a flat bed-like surface 97 and a shoulder element 96 formed therein. The array of contacts 95 rest upon the bed 97 with the double beam-like receptacles 93 at one end of the contact fitting into the slots 112 and 113, and with the double slotted plate-like elements, such as elements 105 and 106, positioned near the shoulder 96 in the housing base 99 as shown in FIG. 3. A plastic element 92, consisting of a set of finger-like elements 109 and an array of more detailed plastic elements 91, fits over the array of contacts 95 with the fingers 109 fitting into the slots 112 and 113 of plastic base 99. The ends 90 of the plastic elements 91 abut against the shoulder 96 in the plastic base 99 above the array of contacts 95. The double slotted upright terminals 105 and 106 of contact array 95 extend up through the slots, such as slots 108, in the array of plastic elements 91, as can be seen more clearly in FIGS. 3 and 4.

Figure 4:
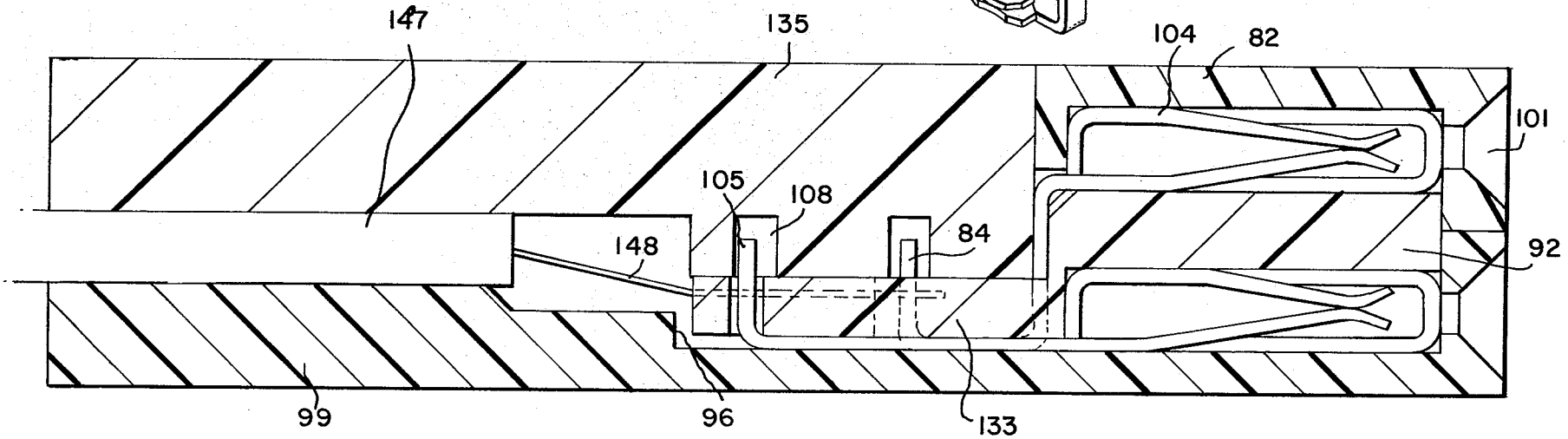
FIG. 4 is the structure of FIG. 3 assembled together rather than being shown in an exploded manner.

The array of contacts 89, which are separated one from the other, fit upon the top surfaces, such as surface 88 of the fingers 109 of plastic element 92, with the slotted elements 84 and 85 being positioned in the manner shown in the structures of FIG. 3 and FIG. 4. The elements 87 and 86, which join the slotted terminals 85 and 84, to the double beam post receiving terminals 104 and 102 fit into the slots 133 and 134 of the plastic section 92. Reference is made to the structure of FIGS. 3 and 4 which illustrate the positioning of such element, such as element 87, in the slot 133 in the plastic element 92. It is to be noted that the positioning of the element 87 in slot 133 of FIGS. 3 and 4, functions to assist in positioning the contacts, such as contacts 103 and 104, in the proper location.

A plastic cap 82 is mounted over contacts 89 and the plastic element 92 in the manner shown in FIGS. 3 and 4. Terminal posts can be inserted into openings such as the opening 101 at the right hand end of the plastic housing 82.

Figure 2:
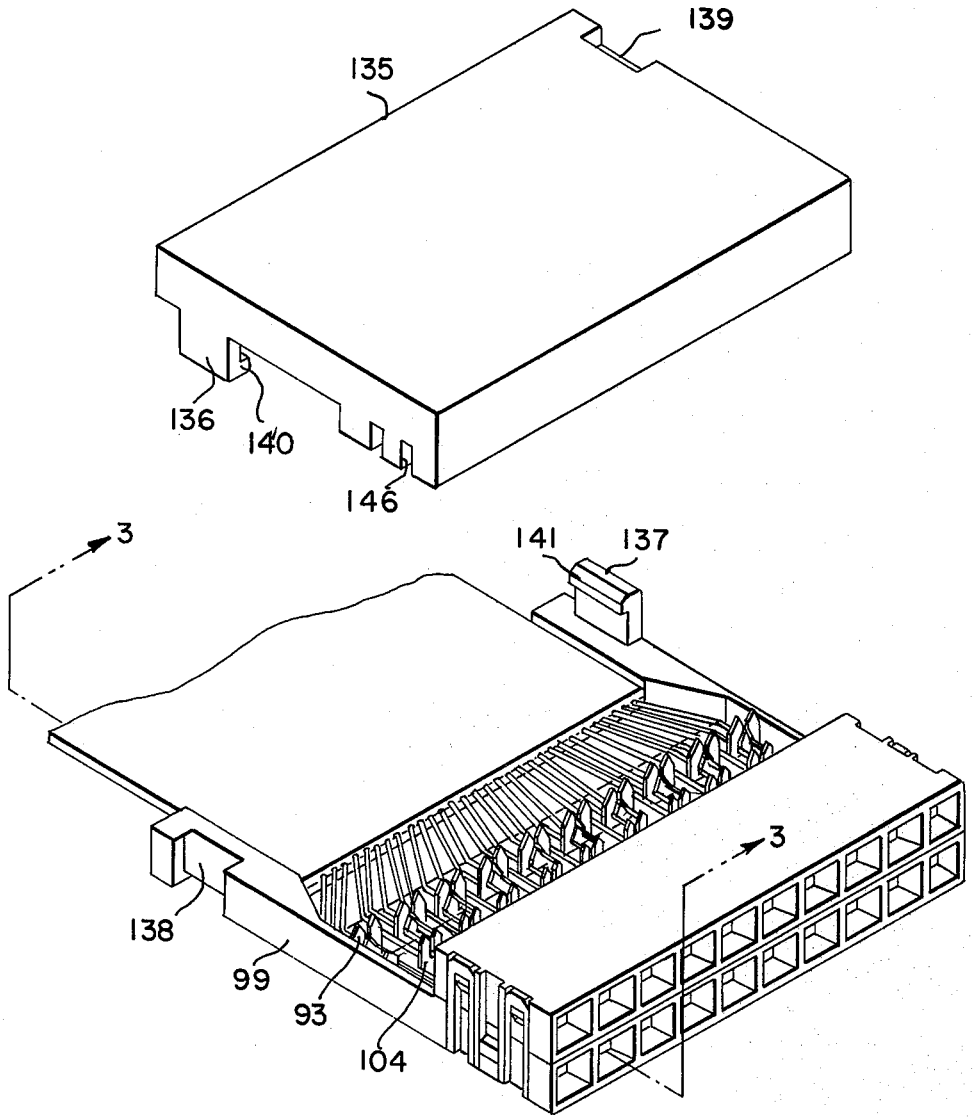
FIG. 2 is an almost completely assembled view of the exploded view shown in FIG. 1 but with the cover removed.

In FIG. 2 there is shown a cap 135 which fits over the assembled structure of FIG. 1. The latches 136 and 137 function to grip the lower housing 99 in slots 138 and 139 which are configured to form a shoulder-like arrangement for the flange portions 140 and 141 of locking latches 136 and 137.

Referring now to FIG. 3 there is shown the base 99 of the plastic housing with a contact 111 mounted therein and with the slotted vertical plate 105 thereof extending upwardly through the slot 108 in plastic element 92 which is positioned above plastic element 99.

The second tier of contacts is represented by contact 104 which is shown above plastic element 92 and is also shown enclosed within cap 82. It is to be understood that contact 104 is positioned within the cavity 79 from below through an open area 145. The vertically positioned slotted plate 84 of terminal 104 is positioned below a cavity 146 in cap 135. The conductive strip 87 joining slotted plate 84 to the double beam section of contact 104 fits into a cavity 133 formed in plastic element 92.

The assembled form of the structure of FIG. 3 is shown in FIG. 4 with similar parts thereof being identified by the same reference characters employed in the structure of FIG. 3.

One difference in the structure of FIG. 4 compared to the structure of FIG. 3 is that cable 147 is shown entered between the plastic elements 135 and 99 with an individual wire 148 extending from the plastic encapsulated cable 147 past the vertical oriented slotted plate 105 and inserted into the slot in the slotted plate 84. It is to be understood that other wires from the multi-wire flat cable 147 are inserted in different slots of the array of the two rows of slotted terminals, including the slot in terminal 105. However, for reasons of clarity only one wire is shown extending from the flat multi-wire cable 147.

Figure 5:
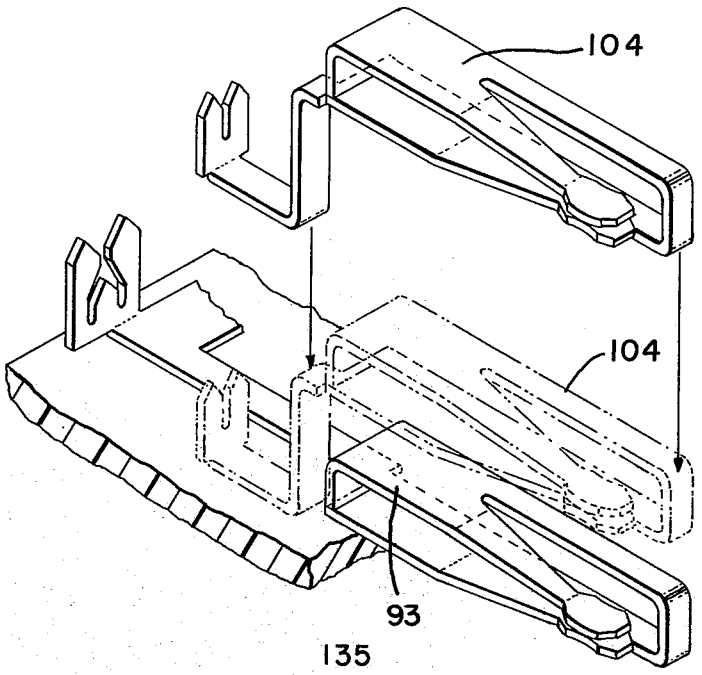
FIG. 5 shows a pair of contacts in a first position where they are separated one from the other for purposes of clarity and further in a side-by-side position as they would be when assembled within the connector of FIG. 1, with the offset construction of the adjacent contacts being shown to illustrate the means by which the slotted plate terminal portions of the two connectors can be positioned side-by-side in the housing bed and the female receptacle ends can be positioned one above the other to form the two tiered arrangement of female receptacles shown in FIG. 1.

In FIG. 5 there are shown two contacts 93 and 104 which, in the structure of FIG. 1 and FIG. 2, exist side-by-side on the bed surface of the bottom plate 99 of the housing. However, for purposes of discussion and clarity the contact 104 is shown in two positions; one position being above the contact 93 so that the full complete configuration of contacts 104 and 93 can be seen. The contact 104 is also shown in phantom next to the contact 93 in its actual physical relationship with said contact 93 when assembled in final form on the bed of the plastic base 99 of FIG. 1.

Figure 6:
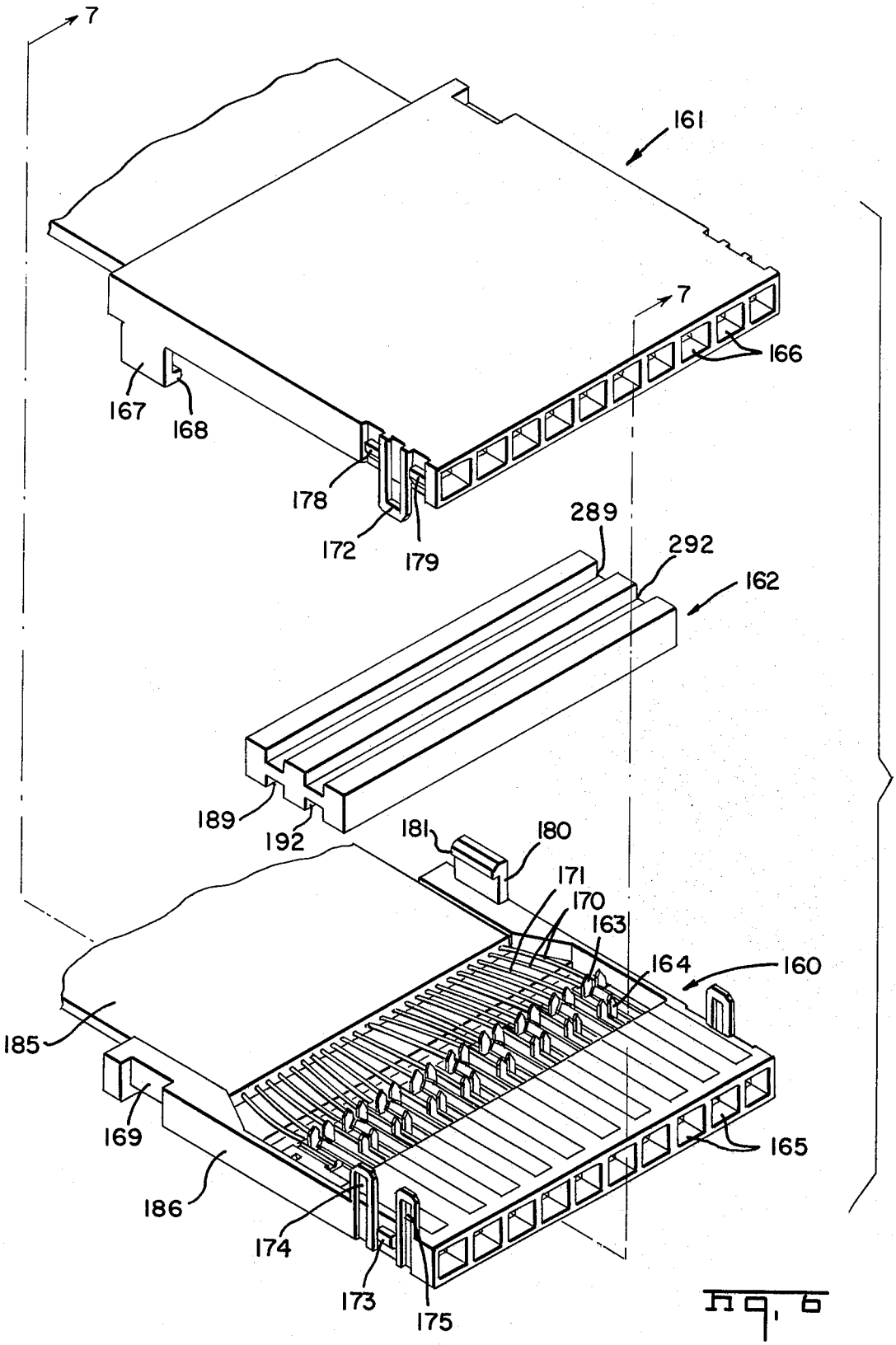
FIG. 6 is a partially exploded perspective view of another embodiment of the invention in which the two halves are essentially hermaphroditic in construction and which can be snapped together to form a single connector capable of terminating two multi-wire cables in a substantially parallel arrangement.
Figure 7:
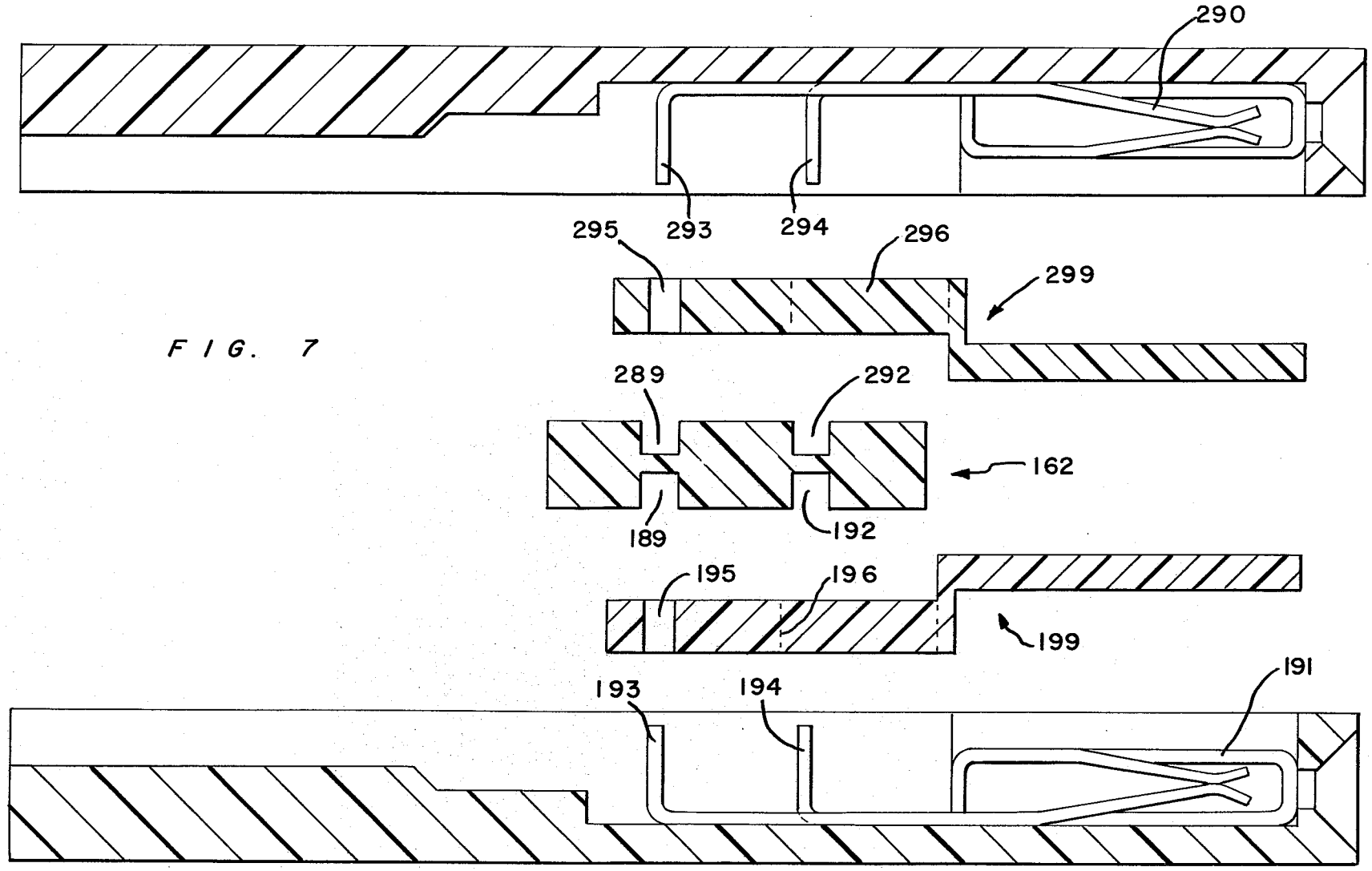
FIG. 7 is a sectional exploded view of the structure of FIG. 6 taken along the plane 7—7 and specifically illustrates how the two halves of the connector are substantially mirror images of each other and are joined in a manner to accommodate two multi-wire cables in a parallel arrangement.

Referring now to FIG. 6 there is shown a form of the invention hermaphroditic in nature in that the connector section 161 is substantially a mirror image of the connector section 160. The two sections 160 and 161 fit together in the manner indicated in FIG. 6 with spacer element 162 interposed therebetween. Since the two sections 161 and 160 are substantially identical mirror images of each other, only section 160 will be described in detail. It can be seen that section 160 consists of two rows of slotted terminals 163 and 164. The row of terminals 163 are all connected together by a common ground strip whereas the row of terminals 164 are individually connected to wires from cable 185 and are configured to extend along the bed of plastic base 186 into the apertures 165 where they become double beamed post receiving terminals, as shown in FIG. 7 by reference characters 190 and 191. It is to be understood, however, that the double slotted beams 190 and 191 are only one possible configuration for terminating the contacts. For example, the double beam configuration 190 could be replaced with a terminal post.

The two sections 161 and 160 are maintained in a fitted-together relationship by means of the locking elements 167 and 180 have flanges 168 and 181 thereon, as shown in FIG. 6. Further locking together of the two sections 160 and 161 is accomplished by the U-shaped member 172 on housing 161 which fits over shoulder 173 in the lower section 160 and also the U-shaped sections 174 and 175 on the lower section 160 which fit respectively over shoulders 178 and 179 of upper section 161. The grooves 189 and 192 in the plastic separator 162 permits entry of the slotted terminals, such as slotted terminals 193 and 194 therein through apertures 195 and 196 in the plastic separating element 199.

Figure 12:
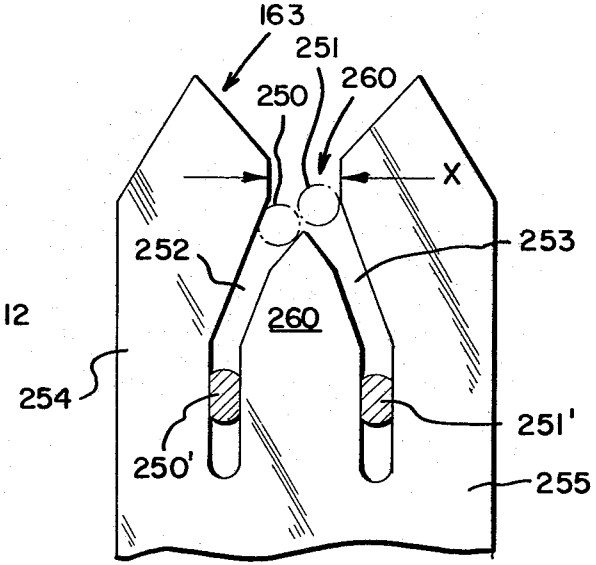
FIG. 12 shows a plan view of a double slotted plate-like terminal.

One feature of the structure of FIG. 6 is the fact that the row of grounded slotted terminals 163 are double slotted as shown in FIG. 12, which will be described in detail hereinafter.

FIG. 7 shows an exploded view of the structure of FIG. 6 taken along the plane 7—7. It can be seen that separator 162 does, in fact, have a slot 192 aligned with the two slotted terminals 193 and 194 which enter said grooves 190 and 192 through apertures 195 and 196 in the plastic separator element 199.

The upper half of the connector shown in the upper half of the drawing in FIG. 7 is substantially identical to the lower half which has been described immediately above. Corresponding parts thereof are identified by similar reference characters, although in a two hundred series rather than in a one hundred series.

Figure 8:
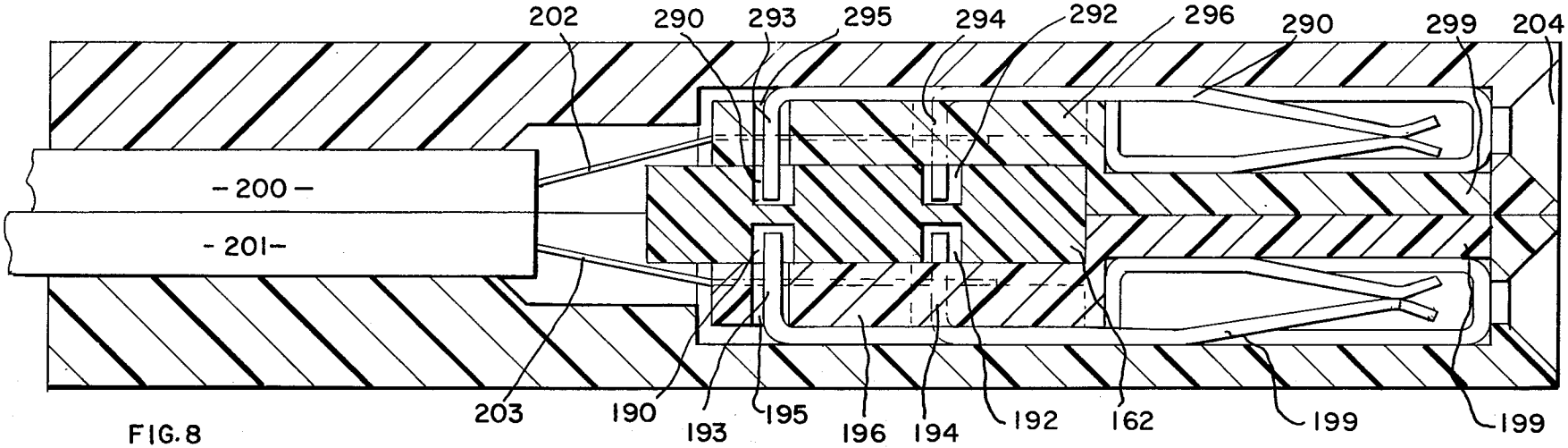
FIG. 8 is a view of the structure of FIG. 7 in an assembled configuration and capable of terminating two multi-wire cables in parallel arrangement.

In FIG. 8 there is shown an assembled form of the structure of FIG. 7. Similar parts are identified by the same reference characters. Also shown in FIG. 8 are two flat multi-wire cables 200 and 201, each with a single wire extending therefrom. Such wires are identified by reference characters 202 and 203 and are inserted respectively in the slots in slotted terminals 294 and 194. Terminal posts can be inserted between the two double beam contacts 290 through aperture 204.

Figure 9:
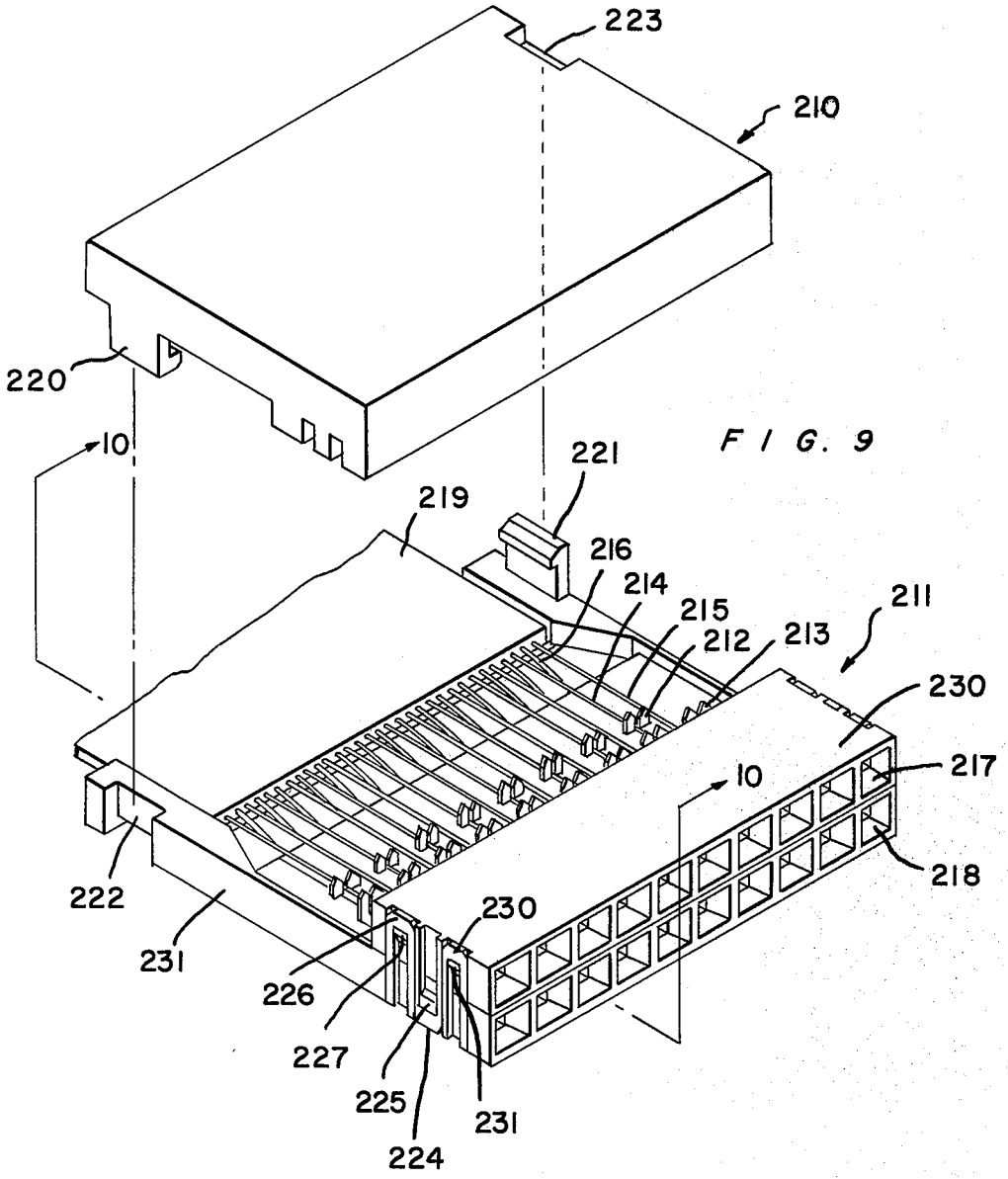
FIG. 9 is a partially assembled perspective view of a third form of the invention but with the cap removed therefrom and illustrating two sets of contacts with their slotted terminals arranged in two rows and with their female receptacles extending to form two tiers of female receptacles.

Referring now to FIG. 9 there is shown still another form of the invention in which there are two rows of slotted plate terminals indicated generally by reference characters 212 and 213 which specifically identifies one of the slotted terminals in each of the two rows. These two rows of slotted terminals each comprise only a portion of the complete contacts which are shown in their entirety in FIG. 5. The double beamed portion of the contact which includes the row of terminals 212 is positioned in channels 218 of FIG. 9. Such double beamed terminations are represented generally by reference character 93 in FIG. 5.

The double beamed termination of the contacts which includes the row of plate terminals 213 is positioned in the cavities 217 in FIG. 9. Such double beamed portion of the last mentioned row of contacts is identified by reference character 104 in FIG. 5.

As discussed above in connection with FIGS. 3, 4 and 5 the two types of terminals 104 and 93 are formed in such a manner that the double beamed portions can exist one above the other in the two tiers of slots 217 and 218 in FIG. 9 and the slotted plates 212 and 213 thereof are positioned in an interleaved manner across the bed of the plastic base 211, and forming two separate rows of slotted plates 212 and 213.

It is to be noted that the two tiers of channels 217 and 218 are comprised of two pieces. More specifically, the bottom tier of channels 218 is formed as an integral part of the plastic base 231 and the upper tier of channels 217 is formed by a cap 230 which is secured to the bottom tier of channels 218 by suitable latching means. Such latching means can consist of the U-shaped elements 224, 226 and 230 which respectively lock over lugs 225, 227 and 231. It is to be noted that the center U-shaped element 224 is part of the cap 230 and the two U-shaped portions 226 and 230 on either side of the middle U-shaped element 224 are integrally formed with the plastic base 231.

Another set of wires, of which one is designated by reference character 216, extend from the multi-wire cable 219 downwardly under the wires 214 and 215. The wires 216 are terminated in a third row of slotted plate terminals which cannot be seen in FIG. 9 but which can be seen in FIGS. 10 and 11.

Figure 10:
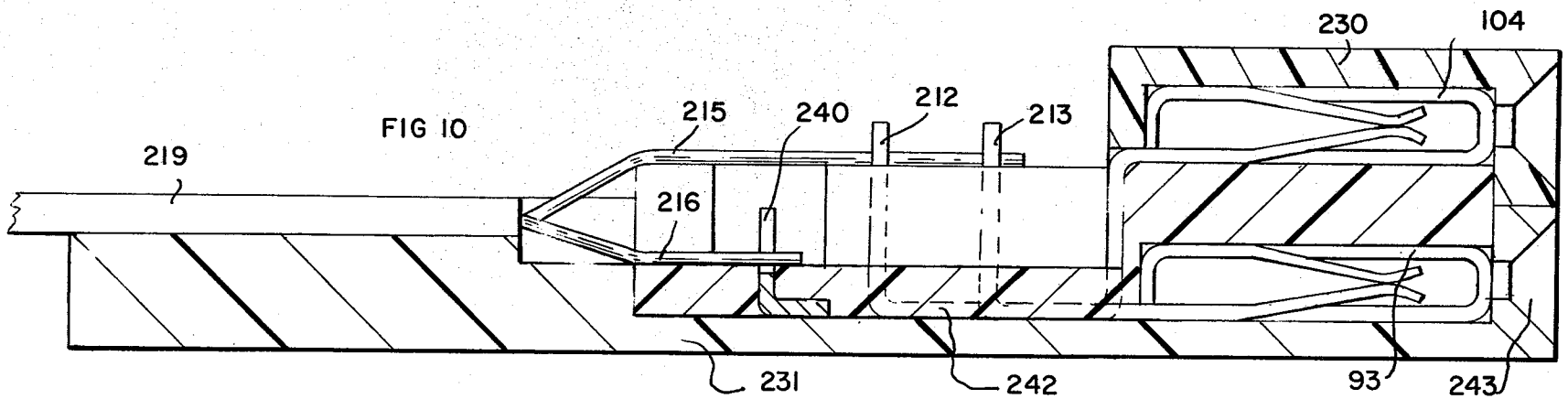
FIG. 10 is a sectional view of the structure of FIG. 9 taken along the plane 10—10 and illustrating in more detail the elevational relationship of two rows of signal handling slotted terminals and a row of slotted terminals in which the wires to be grounded are terminated.

In FIG. 10 the two rows of slotted plate terminals 212 and 213 are shown to be of the same height with the wire 215 extending from multi-wire cable 219 into the slotted terminals 213. The double beam portion which is connected to the slotted plate terminal 213 is identified by reference character 104. The second row of slotted plate terminals 212 which also rests on the bottom surface 242 of plastic housing base 231, is configured in a double beamed arrangement 93 which can receive a terminal post (not shown) in aperture 243, as discussed hereinbefore. The third row of slotted plate terminals mentioned above in connection with FIG. 9 is identified by reference character 240. It is to be understood that there is a plurality of such slotted terminals 240 which extend in a row substantially parallel to the rows of slotted terminals 212 and 213. The row of terminals 240 are at a lower level than the two rows of terminals 212 and 213, thus permitting the positioning of a group of wires 216, which fit into the slots of terminals 240, to also be at a different level than wires 215 and 214 which fit into the two rows of slotted terminals 213 and 212, thus enabling better utilization of available space and separation of the wires further apart than if all of such wires extended from the cable 219 in the same plane.

Figure 11:
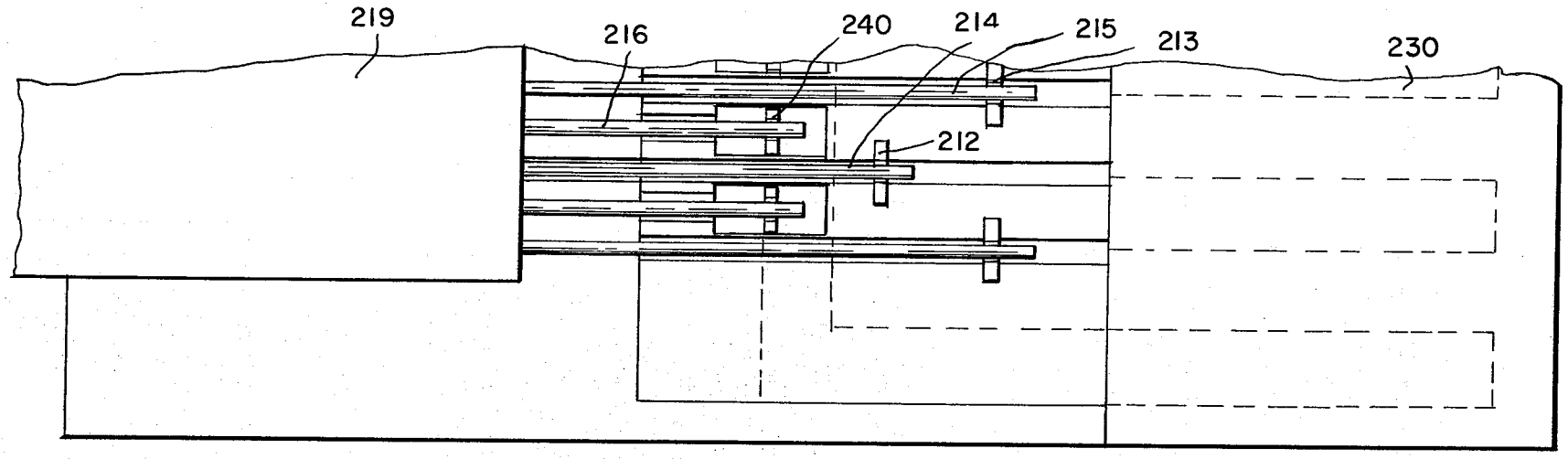
FIG. 11 is a top view of the structure of FIG. 9 and illustrates the positioning of the two rows of signal handling slotted terminals and the third row of slotted terminals which receive the wires from the multi-wire cable which are to be grounded.

In FIG. 11 there is shown a top view of the structure of FIGS. 10 and 9. The two rows of signal carrying slotted plates 212 and 213 are interleaved with wires 215 and 214 extending from the flat cable 219 and being inserted in the slots of said terminals 213 and 212. The third row of slotted terminals 240 receive the wires 216 therein as discussed in connection with FIGS. 9 and 10.

In many applications of connectors of this type it is required that one row of terminals be connected together to some common reference potential, such as ground. In the particular form of the invention shown in FIGS. 9, 10 and 11 the slotted terminals 240 are, in fact, ganged together by a common middle strip which is then connected to some reference potential such as ground. The slotted terminals 214 do not have associated therewith a double beamed portion, such as double beamed portions 104 and 93 of FIGS. 5 and 10.

Referring now to FIG. 12 there is shown a view of the double slotted plate-like terminal employed in the embodiment of the invention shown in FIG. 1. The double slotted terminal of FIG. 12 consists of a plate divided into three segments 254, 255 and a middle section 260 to form the two slots 252 and 253. The entrance 260 of the two slots 252 and 253 has a width X which is less than twice the diameter of one of the wires 250 or 251. Thus, if the two wires 250 and 251 are simultaneously inserted into the slotted terminal, one of the wires must necessarily precede the other as shown in FIG. 12, thereby ensuring that one of the wires 250 goes into the slot 252 and the other wire 251 goes into the slot 253. The final positions of the two wires 250 and 251 is indicated by reference characters 250' and 250'.

Figure 13:
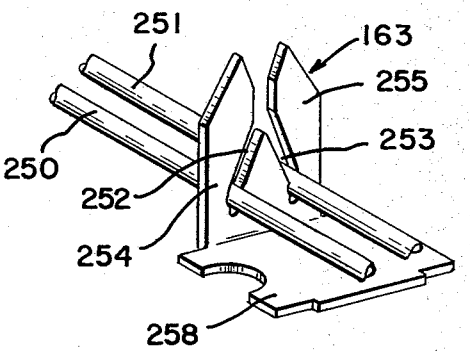
FIG. 13 shows a perspective view of the structure of FIG. 12.

A perspective view of the structure of FIG. 12 is shown in FIG. 13 with similar parts being identified by the same reference characters. In addition a ground plate 258 is shown attached to the slotted terminal 163 and ordinarily is common to a plurality of such double slotted terminals 163 which are arranged in a row as discussed in connection with FIG. 1.

Inasmuch as the distance the wires of the cable must be spaced apart in order to be inserted into the slots of the slotted terminals is different from the spacing between the wires in the cable as originally manufactured, it is necessary to provide a wire separating tool for the assembly of the wires into the slots in the slotted terminals. Such a tool can be essentially a plurality of fingers which are inserted in-between the wires of the stripped cable and then moved laterally to position the wires the desired distance apart for insertion in the slotted terminals. The wires are then lowered simultaneously, in a single motion, into the slotted terminals to complete the termination thereof.

It is to be understood that the forms of the invention shown and described herein are but preferred embodiments thereof and that various modifications and changes can be made not only in the design of the contacts but also the relative positioning of the various slotted terminals without departing from the spirit or scope of the invention.

I claim:

1. In combination, a flat, multi-wire cable and a connector means for terminating said cable comprising:

housing means having a flat bed surface;

a plurality of first contacts each comprising a first plate-like terminal mounted vertically in a first row upon said flat bed surface and each having first slot means formed therein open at one end and closed at the other;

a plurality of second contacts each comprising a second plate-like terminal mounted vertically in a second row upon said flat bed surface of said housing and each having second slot means formed therein open at one end and dividing into second and third slots as it extends into said second plate-like terminal with each of said second and third slots having a closed end and constructed to receive a separate wire of said multi-wire cable;

the plate-like terminals of said first row being interleaved with the plate-like terminals of said second row with the open ends of said first and second slot means being at the top of said slotted plate-like terminals and facing away from said flat bed surface;

second housing means positioned over said first housing means and constructed to retain said wires in said slots in a common plane which is substantially parallel with the plane in which said cable enters said connector means.

2. A combination as in claim 1 in which the closed ends of the slots in said first and second plate-like terminals of said first and second rows are of a substantially equal depth measured from the said flat bed surface;

and further comprising a third row of plate-like terminals each having fourth slot means formed therein with an open end at the top thereof and a closed end and being mounted on said housing bed surface with the closed ends of each of said fourth slot means being a distance from said housing bed surface less than the said substantially equal depth of the closed ends of the slots of said plate-like terminals in said first and second rows.

3. The combination of claim in which:

each contact of said plurality of first contacts further comprises a third terminal;

each contact of said plurality of second contacts further comprises a fourth terminal;

first conductive strip-like means connecting each of said third terminals to one of said plurality of first plate-like terminals;

second conductive strip-like means connecting each of said fourth terminals to one of said second plate-like terminals; and in which said housing means further comprises retaining means for retaining said third and fourth terminals.

4. The combination of claim 3 in which the first connecting strip means and the second connecting strip means are offset in different directions to enable interleaving of the said first and second plate-like terminals and the said third and fourth terminals and further to enable the positioning of the said third terminals in a first tier and the positioning of the fourth terminals in a second tier directly below said first tier of terminals.

5. In combination, a flat multi-wire cable and a connector means for simultaneously terminating the plurality of wires of said cable and comprising:

a plurality of first contacts each comprising a first plate-like terminal having first slot means formed therein open at one end and closed at the other and further comprising a third terminal means connected to said first plate-like terminal;

a plurality of second contacts each comprising a second plate-like terminal having second slot means formed therein comprising a first slot extending from the top edge of said second plate-like element and open at one end and divided into second and third slots as it extends into said second plate-like terminal with each of said second and third slots having a closed end and constructed to receive a separate wire of said multi-wire cable through said first slot;

said plurality of second contacts further comprising a fourth terminal means connected to each of said second plate-like terminals;

a housing comprising:

a flat bed surface for receiving and supporting said flat cable in a plane substantially the same as the plane of the cable as it enters said connector means;

a plurality of separating means mounted on said flat bed surface; and a plurality of retaining means for retaining said third and fourth terminal means;

said first plurality of contacts mounted in said housing with said first plate-like terminals mounted in a first row on said housing bed surface between given ones of said separating means and with said third terminal means retained in first selected ones of said retaining means;

said second plurality of contacts mounted in said housing with said second plate-like terminals mounted in a second row on said housing bed surface between given ones of said separating means in interleaved manner with said first row of slotted plate-like terminals, and with said fourth terminal means retained in second selected ones of said retaining means; and the said plate-like terminals thereof and the terminal means connected thereto of said first and second plurality of contacts being constructed to be offset in opposite directions with respect to each other to enable positioning said first and second pluralities of contacts side-by-side in the connector housing with the said first and second plate-like terminals being interleaved and the third and fourth terminal means being stacked in first and second tiers one upon the other with complete electrical separation between the contacts of said first and second pluralities of contacts.

6. A combination as in claim 5 in which the closed ends of the slots in said first and second plate-like terminals are of a substantially equal depth measured from the said flat bed surface;

and further comprising a third row of plate-like terminals each having fourth slot means formed therein with an open end at the top thereof and a closed end and being mounted on said housing bed with the closed ends of each of said fourth slot means being a distance less from said housing bed than the said substantially equal depth of the closed ends of the slots of said plate-like terminals in said first and second rows.

7. The combination of claim 5 and further comprising:

first strip-like means connecting each of said third terminal means to one of said plurality of first plate-like terminals; and second conductive strip-like means connecting each of said fourth terminal means to one of said plurality of second plate-like terminals.

8. In combination, a flat multi-wire cable and connector means for simultaneously terminating the plurality of wires of said cable and comprising:

a plurality of first contacts each comprising a first plate-like terminal having first slot means formed therein open at one end and closed at the other and a third terminal means connected to said plate-like terminal of each of said first contacts;

a plurality of second contacts each comprising a second plate-like terminal having second slot means formed therein open at one end and dividing into second and third slots as it extends into said second plate-like terminal with each of said second and third slots constructed to receive a separate wire of said multi-wire cable and further comprising a fourth terminal means connected to said plate-like terminal of each of said second contacts;

a housing comprising:

a flat bed surface for receiving and supporting said flat cable in a plane substantially parallel to the plane of the cable as it enters said connector means; and a plurality of retaining means for retaining said third and fourth terminal means;

means for mounting said first plurality of contacts in said housing with said first plate-like terminals positioned in a first row on said housing bed and with said third terminal means retained in first selected ones of said retaining means;

said second plurality of contacts mounted in said housing with said second plate-like terminals mounted in a second row on said housing bed in interleaved manner with said first row of slotted plate-like terminals, and with said fourth terminal means retained in second selected ones of said retaining means; and the said first and second plate-like terminals thereof and the third and fourth terminal means connected thereto of said first and second plurality of contacts being contructed to be offset in opposite directions to each other to enable positioning said first and second pluralities of contacts side-by-side in the connector housing with the said first and second plate-like terminals being interleaved and with the third and fourth terminal means which are connected to adjacent interleaved first and second plate-like terminals being stacked one upon the other with complete electrical separation between the contacts of said first and second pluralities of contacts.

9. The combination of claim 8 in which:

first conductive strip-like means connecting each of said third terminals to one of said plurality of first plate-like terminals, and second conductive strip-like means connecting each of said fourth terminals to one of said second plate-like terminals.

10. The combination of claim 9 in which the first connecting strip means and the second connecting strip means are offset in different directions to enable interleaving of the said first and second plate-like terminals and the said third and fourth terminal means and further to enable the positioning of the said third terminals in a first tier and the positioning of said fourth terminals in a second tier directly below said first tier of terminals with individuals ones of said fourth terminal means directly below individual ones of said third terminal means.

* * * * *